United States Patent [19]

Rudick

[11] Patent Number: 4,869,405

[45] Date of Patent: Sep. 26, 1989

[54] DISPOSABLE PACKAGE FOR DISPENSING LIQUIDS HAVING VISCOSITY COMPENSATION MEANS AND DEVICE THEREFOR

[75] Inventor: Arthur G. Rudick, Marietta, Ga.

[73] Assignee: The Coca-Cola Company, Atlanta, Ga.

[21] Appl. No.: 222,796

[22] Filed: Jul. 22, 1988

[51] Int. Cl.[4] ..... B67D 3/00

[52] U.S. Cl. ..... 222/518; 222/494/420; 137/467.5; 138/45

[58] Field of Search ..... 222/420, 500, 547, 564, 222/514, 513, 518, 422, 424, 457, 491, 494, 495, 496, 497; 137/467.5; 239/75, 520, 579; 138/45

[56] References Cited

U.S. PATENT DOCUMENTS

| | | | |
|---|---|---|---|
| 1,408,977 | 3/1922 | Boivin | 137/467.5 |
| 2,510,252 | 6/1950 | Pine | 222/422 |
| 3,401,850 | 9/1968 | Anderson | 222/518 |
| 3,658,216 | 4/1972 | Schwartzman . | |
| 3,720,352 | 3/1973 | Kozlowski | 222/518 |
| 4,144,041 | 3/1979 | Hou | 138/45 X |
| 4,216,885 | 8/1980 | Sedam . | |
| 4,306,667 | 12/1981 | Sedam et al. . | |
| 4,317,473 | 3/1982 | Gaydos | 138/45 |
| 4,493,441 | 1/1985 | Sedam et al. . | |
| 4,635,824 | 1/1987 | Gaunt et al. | 222/518 |

*Primary Examiner*—Kevin P. Shaver
*Assistant Examiner*—Mona C. Beegle
*Attorney, Agent, or Firm*—Birch, Stewart, Kolasch & Birch

[57] ABSTRACT

A device is provided which provides compensation for alterations in viscosity of liquids dispensed by gravity from containers such as those used in post-mix carbonated beverage dispensing systems. The device has a valve element which collects temporarily the liquid being dispensed and, as a function of the viscosity of the liquid, adjusts the effective size of the discharge opening in the container to compensate for that viscosity.

47 Claims, 2 Drawing Sheets

DISPOSABLE PACKAGE FOR DISPENSING LIQUIDS HAVING VISCOSITY COMPENSATION MEANS AND DEVICE THEREFOR

BACKGROUND OF THE INVENTION

The present invention is related generally to disposable packages for dispensing a liquid from a container with a controlled rate of flow which is independent of the viscosity of the liquid at the time of dispensing and is more particularly concerned with such a package for dispensing syrup mixtures for use in a post-mix beverage dispensing system and a device for compensating for changes in the viscosity related to temperature variations in the syrup being dispensed.

Until recently, the majority of commercially available post-mix carbonated beverage dispenser units have been designed for large volume commercial uses such as in fast food restaurants. More recently, however, some attempts have been made in the beverage dispenser industry to reduce the cost, size and weight of post-mix beverage dispenser units sufficiently to make them available for use by the general public. Exemplary of such units are those shown in U.S. Pat. Nos. 4,306,667 to Sedam et al. and 4,493,441 to Sedam et al. Both of these patents are assigned to the assignee of the present application. The post-mix beverage dispensing units shown in these patents have been designed for placement in refrigerators, such as that shown in U.S. Pat. No. 4,306,667, and as free standing systems having refrigeration means incorporated therein, such as the system shown in U.S. Pat. No. 4,493,441. The disclosures of these two patents are, to the extent pertinent, incorporated herein by reference.

Basically, all such post-mix carbonated beverage dispensing systems utilize and mix three different ingredients to produce the resulting beverage. Those ingredients are a flavored syrup, water and $CO_2$. For such systems to be accepted by the consuming public, the supplies of those ingredients must be capable of being quickly and easily replenished during use by an unskilled consumer.

Preferably, the syrup component is made available to the consumer in a disposable package available at supermarkets. An exemplary disposable syrup package of the prior art which may be used in the small post-mix beverage dispensing systems is disclosed in U.S. Pat. No. 4,216,885 to Sedam et al. This patent is also assigned to the same assignee as is the present invention and is, to the extent pertinent, incorporated herein by reference. The Sedam syrup package incorporates a flow control tube. In this arrangement, the tube is prepositioned at manufacture to accommodate the desired flow under the expected temperature conditions. That is, the position of the tube is such that it operates to control the flow of syrup from the package at the working ambient temperature in which the syrup is to be utilized, i.e., that of a refrigerated compartment.

A similar arrangement is shown in my co-pending application Ser. No. 918,714 which was filed on Oct. 14, 1986, entitled DISPOSABLE SYRUP PACKAGE HAVING INTEGRAL DISPOSABLE VALVE ASSEMBLY. This application is again assigned to the assignee of the present invention and is, to the extent pertinent, incorporated herein by reference. The flow control tube in this application operates similarly to that disclosed in the Sedam patent discussed above.

In use, however, the syrup packages are not always maintained at a single precise, refrigerated temperature. Often, the syrup packages are stored at room temperature. Therefore, when a new package is inserted into the post-mix beverage dispensing system, a considerable period of time is required in order for the syrup to reach the desired uniform cold temperature for which the package was designed. During the transition period, if the consumer desires to draw a beverage from the dispensing system, due to the decreased viscosity of the syrup at the elevated temperature, it is quite possible for an inordinately large amount of syrup to be dispensed thereby deleteriously altering the flavor of the beverage produced.

One means by which such viscosity changes may be overcome is through the use of a metering device such as is shown in U.S. Pat. No. 3,658,216 to Schwartzman. In a metering device, a first valve is opened to permit the flow of fluid into a reservoir, the bottom of which is blocked by a second valve. When the reservoir is full, the first valve closes and the second valve is opened allowing the predetermined metered quantity of fluid to be dispensed. Such a metering device is relatively complex and is subject to failure if either of the valves fails to seat properly.

SUMMARY OF THE INVENTION

Accordingly, it is an object of the present invention to provide a viscosity compensating device which is suitable for incorporation into a post-mix carbonated beverage dispensing system.

It is a further object of the present invention to provide a disposable package for dispensing a liquid with a controlled rate of flow that is independent of the viscosity of the liquid at the time of dispensing.

It is a further object of the invention to provide a viscosity compensating device that may be affixed to a container across a discharge opening in the container so that when a liquid is dispensed by gravity feed from that container, through the discharge opening, a controlled rate of flow of the liquid independent of viscosity is accomplished.

A still further object of the present invention is to provide such a viscosity compensating device that is simple in construction, economical to produce and reliable in operation so that it may be either incorporated directly into a disposable package, affixed to such a package at the time of utilization or mounted within the apparatus through which the liquids are dispensed by gravity feed.

It is a still further object of the present invention to provide a novel disposable package and viscosity compensating device which may be combined to form a disposable system for regulating the rate of flow of syrup in a post-mix carbonated beverage dispensing system.

Briefly, the invention in its broadest aspect comprises a device which is adapted for use in the dispensing of a liquid with a controlled rate of flow which is independent of the viscosity of the liquid at the time of dispensing. The device includes a valve element which is movably aligned and adapted to be placed in cooperative communication with a discharge opening for the liquid to be dispensed to regulate the rate of flow of liquid through the discharge opening. The valve element has means therein for accumulating temporarily a portion of the liquid dispensed through the discharge opening, the magnitude of the portion of the liquid accumulated being directly related to the viscosity of the liquid being dispensed. The device also includes a means interposed between the valve element and the container. This means is disposed such as to biasably maintain the valve element in cooperative communication with the discharge opening. As a result, the accumulated liquid in the valve element biases the means interposed between the valve element and the container relative to the discharge opening thereby withdrawing the valve element from engagement with the discharge opening and permitting an increase in effective size of the discharge opening which is directly proportional to the viscosity of the liquid being dispensed so that the liquid flow rate through the discharge opening is maintained substantially uniform independent of the viscosity of the liquid.

In another aspect of the invention, a novel disposable package is provided for dispensing a liquid at a controlled rate of flow which is independent of the viscosity of the liquid at the time of dispensing. The package includes a container having a discharge end in which there is defined a discharge opening through which the liquid may be dispensed. The discharge end is located at the bottom of the container when the liquid is being dispensed therefrom. A viscosity compensating device as defined in the preceding paragraph is affixed to the container so as to be positioned across the discharge opening of the container to control the flow rate of the liquid.

In a first, more specific embodiment of the present invention, a viscosity compensating device is provided for use in connection with a disposable syrup container for a post-mix carbonated beverage dispensing system for dispensing the syrup with a controlled rate of flow which is independent of the viscosity of the syrup at the time of dispensing. The viscosity compensating device is designed to be incorporated directly in the discharge opening on the syrup container so as to be disposed directly across the discharge opening and below it so that the syrup may be dispensed through the discharge opening. The viscosity compensating device comprises a valve element which is axially aligned and adapted to be placed in cooperative communication with the discharge opening. The valve element is moveable along the axis of the discharge opening to regulate the flow of syrup through the discharge opening. The valve element has a circularly cross-sectioned stem which extends through the discharge opening into the interior of the container. Adjacent the proximal end of the valve stem and, when the syrup can flow out of the container, exterior to the container is a needle valve portion which is in cooperative communication with the discharge opening. At the distal end of the valve member stem is a shoulder. Interposed between the shoulder and the interior of the container adjacent to the discharge opening is a coil spring. The end of the coil spring which is against the container is seated in a recess formed around the discharge opening in the container. The valve element also includes a vented bowl depending from the proximal end of the valve stem for accumulating temporarily a portion of the syrup dispensed through the discharge opening. The magnitude of the portion of the syrup accumulated in the vented bowl prior to its escape from the vented bowl is directly related to the viscosity of the syrup being dispensed. As a result, the accumulated syrup in the vented bowl of the valve element biases the coil spring to move the needle valve portion of the valve element from engagement with the discharge opening and permitting an increase in effective size in the discharge opening which is proportional to the viscosity of the syrup being dispensed so that the syrup flow rate through the discharge opening is maintained substantially uniform independent of the viscosity of the syrup.

In a second, more specific embodiment of the present invention, a viscosity compensating device is provided for use with a disposable syrup container for a post-mix carbonated beverage dispensing system for dispensing the syrup with a controlled rate of flow which is independent of the viscosity of the syrup at the time of dispensing. The viscosity compensating device is adapted to be affixed to a depending flange on the syrup container so as to be positioned across a discharge opening disposed within the depending flange through which the syrup may be dispensed. The viscosity compensating device comprises a valve element which is axially aligned and adapted to be placed in cooperative communication with the discharge opening. The valve element is movable along the axis of the discharge opening to regulate the flow of syrup through the discharge opening. The valve element has a round needle valve member which is in cooperative communication with the discharge opening and a vented bowl depending from the needle valve member for accumulating temporarily a portion of the syrup dispensed through the discharge opening. The magnitude of the portion of the syrup accumulated in the vented bowl prior to its escape from the vented bowl is directly related to the viscosity of the syrup being dispensed. The device further includes an elastomeric element which is comprised of a rim at its periphery which is adapted to be affixed to the flange on the syrup container, an interior hub which is affixed to the valve member, and a vented biasable means between the rim and hub. The vented biasable means is formed of an elastomeric materiai. The elastomeric element is disposed such as to maintain the needle member of the valve element in cooperative communication with the discharge opening. As a result, the accumulated syrup in the vented bowl of the valve element biases the elastomeric element relative to the discharge opening thereby withdrawing the needle member of the valve element from engagement with the discharge opening and permitting an increase in effective size of the discharge opening which is proportional to the viscosity of the syrup being dispensed so that the syrup flow rate through the discharge opening is maintained substantially uniform independent of the viscosity of the syrup.

Further objects, advantages and features of the invention will be apparent in the arrangement and construction of the constituent parts in detail as set forth in the following specification taken together with the accompanying drawing.

DETAILED DESCRIPTION OF THE PREFERRED EMBODIMENT

Figure 1:
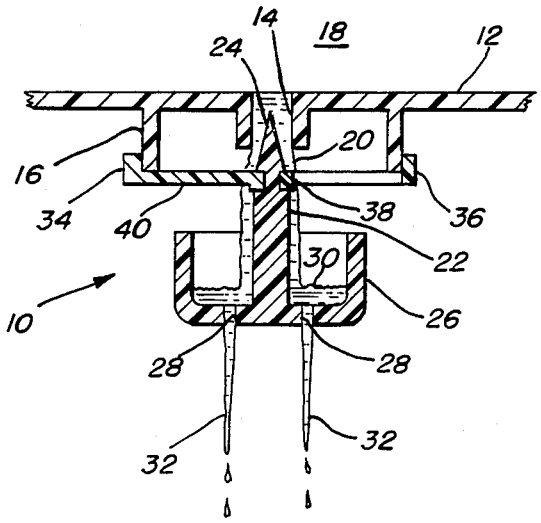
FIG. 1 is a cross-sectional view of a portion of a disposable syrup container for use in a post-mix beverage dispensing system having a viscosity compensating device according to the present invention attached thereto and indicating the operation of the invention with a liquid of a low viscosity.
Figure 2:
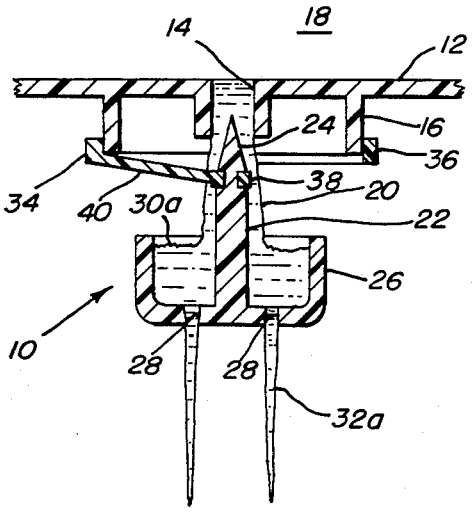
FIG. 2 is a similar cross-sectional representation of the container and viscosity compensating device of FIG. 1 except that a liquid of a higher viscosity is contained within and is being dispensed from the container.
Figure 3:
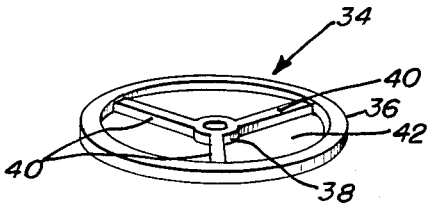
FIG. 3 is an isometric representation of a preferred embodiment of the elastomeric element of the viscosity compensating device shown in FIGS. 1 and 2.

In referring to the various figures of the drawing hereinbelow, like reference numerals will be utilized to refer to identical parts of the apparatus. Referring initially to FIGS. 1–3, there is shown a first embodiment of a viscosity compensating device according to the present invention which is indicated generally by the reference numeral 10. The viscosity compensating device 10 is shown as being affixed to the bottom of a typical disposable syrup container 12 for use in a post-mix carbonated beverage system. The container 12 includes a discharge opening 14 in its base. The viscosity compensating device is indicated in FIGS. 1 and 2 to be affixed to a depending flange 16 on the base of the container 12 and surrounding the discharge opening 14. When the viscosity compensating device 10 is withdrawn from contact with the discharge opening 14, a liquid stored within the container 12, as indicated generally by the reference number 18, is permitted to be dispensed by gravity feed through the discharge opening 14. Such flow of the dispensed liquid is indicated generally in FIGS. 1 and 2 by the reference number 20.

The viscosity compensating device 10 is comprised generally of a valve element 22 and an elastomeric element 34. The valve element 22 is movably aligned with and is in cooperative communication with the discharge opening 14 in the container 12. Preferably, the valve element 22 includes a needle member 24 which is adapted to cooperatively engage the discharge opening 14. As the needle member 24 of the valve element 22 is moved into and out of engagement with the discharge opening 14, the relative effective size of the discharge opening is decreased and increased, respectively, to regulate the rate of flow of liquid through the discharge opening 14. The cross-sectional configuration of the needle member 24 conforms generally to that of the discharge opening 14 and is, in the preferred embodiment of circular cross-section, i.e., round.

The valve element 22 further includes a means, shown as vented bowl 26 in FIGS. 1 and 2, for accumulating temporarily a portion of the liquid dispensed through the discharge opening 14. The vented bowl 26 is connected to and depends from the distal end of the needle member 24 of the valve member 22. The vented bowl 26 includes a plurality of vent holes 28 in the base thereof through which the liquid dispensed from the container 12 is allowed to escape as indicated at the reference numeral 32. The liquid as dispensed through the vent holes 28 is then utilized by the post-mix beverage system to provide a carbonated beverage as described in the aforementioned system patents to Sedam et al.

The viscosity compensating device 10 also comprises an elastomeric element 34 which is adapted to be affixed at its periphery to the container 12 about the discharge opening 14 and at its interior to the valve element 22. The elastomeric element is disposed such as to maintain the valve element 22 in cooperative communication with the discharge opening 14.

In the preferred embodiment for the elastomeric element 34 as shown in FIG. 3, a rim 36 is provided which may be affixed to the depending flange 16 on the container 12. Extending from the rim 36 radially inward to a hub 38 are a plurality of spokes of elastomeric material 40. The plurality of spokes 40 provide vented spaces 42 therebetween. When the elastomeric element is affixed to the needle member 24 of the valve member 22, the vented space 42 permits the liquid being dispensed from the container 12 to flow therethrough and into the vented bowl 26. On the other hand, if the elastomeric element were affixed at its interior to the bowl 26, the vents 42 in the elastomeric element would then permit air to pass therethrough so that the liquid dispensed from the container 12 is permitted to flow outwardly through the vent holes 28 in the bowl 26.

In operation, when a liquid of a relatively low viscosity, such as a syrup which has been stored at room temperature and only recently placed in a post-mix beverage dispensing system, is in the container 12, such a liquid flows easily through the discharge opening 14 when the needle member 24 is pushed only a short distance away from the discharge opening as is indicated in FIG. 1. Such a low viscosity liquid then passes through the elastomeric member 34 and is accumulated temporarily in the vented bowl 26. Due to its low viscosity, the liquid passes easily through the vent holes 28 and only a small portion of the liquid remains accumulated in the bowl 26 as is indicated by the low level 30 of liquid.

Conversely, when a more viscous liquid is housed in the container 12, as, for example, a refrigerated syrup, a larger portion of such fluid accumulates in the bowl 26, as indicated by the higher liquid level 30*a* in FIG. 2, prior to the escape of the liquid through the vent holes 28 as indicated by the more viscous flow shown graphically at reference numeral 32*a*. The greater level of liquid 30*a*, for a more viscous liquid, has two complimentary effects. First, the higher level of liquid in the vented bowl 26 serves to provide the greater hydraulic pressure necessary to force the more viscous liquid through the vent holes 28. Secondly, the greater amount of liquid collected in the vented bowl 26 for a viscous liquid, as shown in FIG. 2, increases significantly the effective weight of the viscosity compensating device 10 thereby biasing the elastomeric member 34 so that the needle member 24 is withdrawn further from the discharge opening 14 thereby effectively increasing the size of the discharge opening to permit a greater quantity of the more viscous fluid to flow from the container 12 per unit of time. Therefore, the effective size of the discharge opening 14 is modified in direct relation to the viscosity of the liquid stored in the container 12 at the time the liquid is dispensed for use in a post-mix carbonated beverage dispensing system.

The number, size and elasticity of the spokes 40 of the elastomeric member 34 may be readily determined by one of ordinary skill in the art from the viscosities of the liquid to be housed within the container 12 through the range of temperatures to which that liquid is likely to be subjected during normal usage. Similarly, the number and size of the vent holes 28 which are provided in the device may be determined from those same viscosity values.

Figure 4:
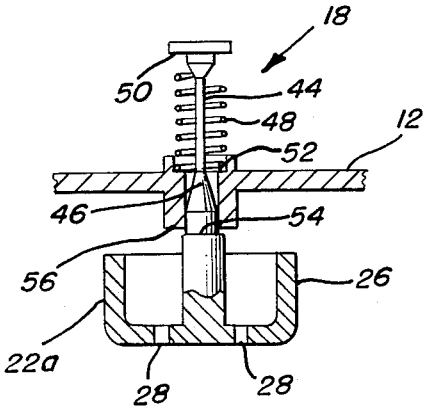
FIG. 4 is a partial cross-sectional view of a portion of a disposable syrup container for use in a post-mix carbonated beverage dispensing system having a second embodiment of a viscosity compensating device according to the present invention incorporated therein and showing the position of the device at flow shut off.
Figure 5:
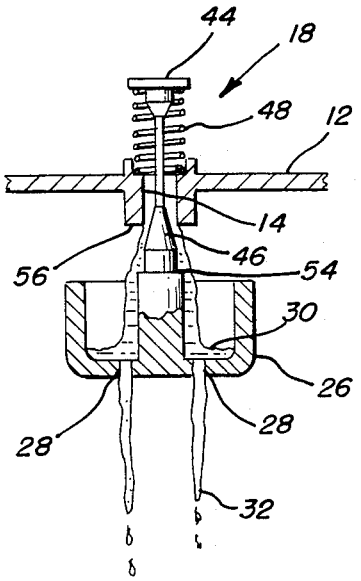
FIG. 5 is a similar cross-sectional representation of a disposable syrup container and the viscosity compensating device of FIG. 4, except that the valve element has been displaced downwardly to permit flow of a liquid of a low viscosity through a discharge opening in the container.
Figure 6:
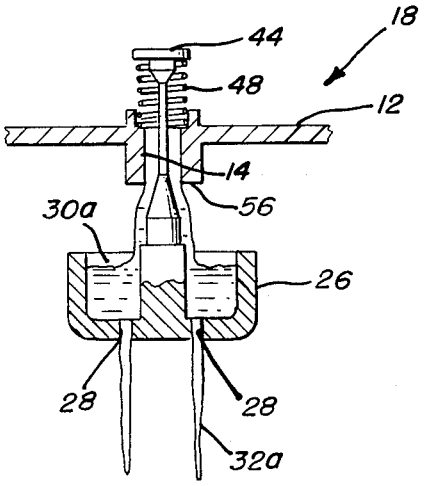
FIG. 6 is another similar cross-sectional representation of the container and viscosity compensating device of FIG. 4, except that a liquid of a higher viscosity than that shown in FIG. 5 is contained within and is shown being dispensed from the container.

Turning now to FIGS. 4–6 which illustrate a second embodiment of the present invention, in the viscosity compensating device shown, the needle valve portion of the valve element **22*a* is extended in the form of a stem 44 which passes axially through the discharge opening 14 and into the interior of the container 12. Thus, the needle valve portion 46 of the valve element is located, in this embodiment, on the proximal end of the stem 44. The stem 44 has an extended portion of narrow cross-section which terminates in a shoulder 50 which is in the interior of the container 12. Below the valve portion 46 of the valve element 22*a* is a second should 54. The shoulder 54, in FIG. 4, abuts the bottom of a flange 56. Flange 56 depends from the bottom of the container 12 and surrounds the discharge opening 14**.

Surrounding the narrowed portion of the stem 44 is a coil spring 48. The coil spring 48 is positioned so as to be able to bear at one end against the shoulder 50 on the stem 44 and at the opposite end against the container 12 in a recess 52 which surrounds the interior of the discharge opening 14. The bowl portion 26 of the valve element **22*a* is substantially identical and operates similarly to that in the previously described embodiment (FIGS. 1–3) as is indicated generally in FIGS. 5 and 6**.

The needle portion 46 of the stem 44 of the valve element 26 is, at its widest, of substantially the same size as the discharge opening 14 in the container 12. Therefore, when it is desirable to prohibit flow of liquid from the container 12, the needle portion 46 may be forced into the discharge opening 14 to close the discharge opening and prevent any further flow of liquid through that discharge opening. This is indicated in FIG. 4. As presently contemplated, the needle portion 46 of the stem 44 is inserted into the discharge opening 14 by a force external to the viscosity compensating device. For example, such an insertion could be made by a machine during the manufacturing and filling process of the container and, by the consumer to re-close and seal the syrup container manually upon removal of the container from the system. Of course, the consumer would also manually extract the needle portion 46 from the discharge opening 14 at the time of installation of the container 12 in a beverage dispenser system.

While a variety of spring devices could be utilized, a coil spring 48 surrounding the narrowed portion of the stem 44 is presently preferred.

As in the case of the embodiment shown in FIGS. 1 through 3, one of ordinary skill in the art, from the viscosities of the liquid within the container 12 and the range of temperatures to which that liquid is likely to be subjected during normal usage, can readily determine the mechanical characteristics of a suitable spring material for use in the coil spring 48. Clearly, however, since the coil spring 48 serves to partially restrict the flow of liquid into the discharge opening 14, particularly at higher viscosities as shown in FIG. 6, the spring design should be such as to permit sufficient flow of the liquid through it under all expected operating conditions.

While there have been shown and described what are considered to be preferred embodiments of the present invention, it will be obvious to those skilled in the art that various changes and modifications may be made therein without departing from the spirit and scope of the invention as defined in the appended claims.

What is claimed is:

1. A disposable package for dispensing a liquid with a controlled rate of flow which is independent of the viscosity of the liquid at the time of dispensing, the package comprising:

a container having a discharge end in which there is defined a discharge opening through which the liquid may be dispensed, the discharge end being located at the bottom of the container when the liquid is being dispensed therefrom; and a viscosity compensating device being affixed to the container so as to be positioned across the discharge opening, the viscosity compensating device comprising:

a valve element which is movably aligned and in cooperative communication with the discharge opening to regulate the rate of flow of liquid through the discharge opening, the valve element having means therein for accumulating temporarily a portion of the liquid dispensed through the discharge opening, the magnitude of the portion of the liquid accumulated being directly related to the viscosity of the liquid being dispensed; and means interposed between the valve element and the container for biasably maintaining the valve element in cooperative communication with the discharge opening, whereby the accumulated liquid in the valve element biases the means for biasably maintaining relative to the discharge opening thereby withdrawing the valve element from the discharge opening and permitting a change in effective size of the discharge opening which is proportional to the viscosity of the liquid being dispensed so that the liquid flow rate through the discharge opening is maintained substantially uniform independent of the viscosity of the liquid.

2. A disposable package according to claim 1, wherein the valve element further comprises a stem extending through the discharge opening into the interior of the container and the means for biasably maintaining is a spring interposed between the stem of the valve element and the container.

3. A disposable package according to claim 2, wherein the stem of the valve element includes a needle portion which is in cooperative communication with the discharge opening in the container and the valve element further comprises a vented bowl depending from the needle portion of the stem for temporarily accumulating a portion of the liquid.

4. A disposable package according to claim 3, wherein the vented bowl has a plurality of vent holes in its base through which the temporarily accumulated liquid can drain.

5. A disposable package according to claim 4, wherein the bowl's capacity and the number and size of the vent holes are such that the amount of accumulated liquid is sufficient to bias the spring to withdraw the needle portion of the stem of the valve element from the discharge opening sufficiently to compensate for a change in the viscosity of the liquid being dispensed to maintain the liquid flow rate substantially uniform.

6. A disposable package according to claim 2, wherein the spring is a coil spring surrounding the stem of the valve element.

7. A disposable package according to claim 6, wherein the coil spring bears, at its distal end, against a shoulder on the stem of the valve member and, at its proximal end, against the interior of the bottom of the container in a recess formed about the discharge opening.

8. A disposable package according to claim 1, wherein the means for biasably maintaining the valve element is an elastomeric element affixed at its periphery to the container about the discharge opening and at its interior to the valve element.

9. A disposable package according to claim 8, wherein the valve element comprises a needle member which is in cooperative communication with the discharge opening in the container and a vented bowl depending from the needle member for temporarily accumulating a portion of the liquid.

10. A disposable package according to claim 9, wherein the vented bowl has a plurality of vent holes in its base through which the temporarily accumulated liquid can drain.

11. A disposable package according to claim 10, wherein the bowl's capacity and the number and size of the vent holes are such that the amount of accumulated liquid is sufficient to bias the elastomeric element to withdraw the needle member of the valve element from the discharge opening sufficiently to compensate for a change in the viscosity of the liquid being dispensed to maintain the liquid flow rate substantially uniform.

12. A disposable package according to claim 10, wherein the elastomeric member is affixed, at its interior, to the needle member.

13. A disposable package according to claim 8, wherein the elastomeric member is vented to permit the passage of fluids therethrough.

14. A disposable package according to claim 13, wherein the elastomeric member is comprised of a rim at the periphery, a hub at the interior, and a vented biasable means between the rim and hub for permitting compensating movement of the valve element relative to the discharge opening to maintain the liquid flow rate substantially uniform.

15. A disposable package according to claim 14, wherein the means for permitting compensating movement of the valve element is a plurality of spokes of elastomeric material extending between the rim and hub of the elastomeric element.

16. A disposable package according to claim 15, wherein the valve element comprises a needle member which is in cooperative communication with the discharge opening in the container and a vented bowl depending from the needle member for temporarily accumulating a portion of the liquid, the hub of the elastomeric member being affixed to the needle member.

17. A disposable package according to claim 8, wherein the container has a depending lip surrounding the discharge opening, the elastomeric member being affixed at its periphery to the depending lip.

18. A disposable package according to claim 1, wherein the disposable package is a syrup container adapted for use in a post-mix carbonated beverage dispensing system.

19. A disposable package according to claim 1, wherein the valve element includes a needle which is in cooperative communication with the discharge opening in the container, the needle, at its widest, being substantially of the same size as the discharge opening, and the means for biasably maintaining permits the needle of the valve element to be forced into the discharge opening to stop the flow of liquid from the container.

20. A disposable syrup package for use in a post-mix carbonated beverage dispensing system for dispensing a syrup with a controlled rate of flow which is independent of the viscosity of the syrup at the time of dispensing, the package comprising:

a syrup container having a discharge end in which there is defined a round discharge opening through which the syrup may be dispensed, the discharge end being located at the bottom of the container when syrup is being dispensed therefrom, the container having an internal recess surrounding the discharge opening; and a viscosity compensating device being affixed to the syrup container so as to be positioned across the discharge opening, the viscosity compensating device comprising:

a valve element which is axially aligned and in cooperative communication with the discharge opening, the valve element being movable along the axis of the discharge opening to regulate the rate of flow of syrup through the discharge opening, the valve element having a stem extending through the discharge opening into the interior of the container, the stem having, at its distal end, a shoulder and, at its proximal end, a round needle valve portion which is external to and in cooperative communication with the discharge opening, and a vented bowl depending from the needle valve portion of the stem for accumulating temporarily a portion of the syrup dispensed through the discharge opening, the magnitude of the portion of the syrup accumulated in the vented bowl prior to its escape from the vented bowl being directly related to the viscosity of the syrup being dispensed; and a coil spring surrounding the stem of the valve element and bearing, at its distal end, against the shoulder on the stem of the valve element and, at its proximal end, in the internal recess surrounding the discharge opening in the container such that the valve element is maintained in cooperative communication with the discharge opening, whereby the accumulated syrup in the vented bowl of the valve element biases the coil spring relative to the discharge opening thereby withdrawing the needle portion of the stem of the valve element from engagement with the discharge opening and permitting a change in effective size of the discharge opening which is proportional to the viscosity of the syrup being dispensed so that the syrup flow rate through the discharge opening is maintained substantially uniform independent of the viscosity of the syrup.

21. A disposable syrup package according to claim 20, wherein the vented bowl has a plurality of vent holes in its base through which the temporarily accumulated syrup can drain.

22. A disposable syrup package according to claim 21, wherein the bowl's capacity and the number and size of the vent holes are such that the amount of accumulated syrup is sufficient to bias the coil spring to withdraw the needle portion of the stem of the valve element from the discharge opening sufficiently to compensate for a change in the viscosity of the liquid being dispensed to maintain the syrup flow rate substantially uniform.

23. A disposable syrup package for use in a post-mix carbonated beverage dispensing system for dispensing a syrup with a controlled rate of flow which is independent of the viscosity of the syrup at the time of dispensing, the package comprising:

a syrup container having a discharge end in which there is defined a round discharge opening through which the syrup may be dispensed, the discharge end being located at the bottom of the container when syrup is being dispensed therefrom, the container having a depending flange surrounding the discharge opening; and a viscosity compensating device being affixed to the flange on the syrup container so as to be positioned across the discharge opening, the viscosity compensating device comprising:

a valve element which is axially aligned and in cooperative communication with the discharge opening, the valve element being movable along the axis of the discharge opening to regulate the rate of flow of syrup through the discharge opening, the valve element having a round needle valve member which is in cooperative communication with the discharge opening, and a vented bowl depending from the needle valve member for accumulating temporarily a portion of the syrup dispensed through the discharge opening, the magnitude of the portion of the syrup accumulated in the vented bowl prior to its escape from the vented bowl being directly related to the viscosity of the syrup being dispensed; and an elastomeric element which is comprised of a rim at its periphery which is affixed to the flange on the syrup container, an interior hub which is affixed to the valve member, and a vented biasable means formed of an elastomeric material between the rim and hub, the elastomeric element being disposed such as to maintain the valve element in cooperative communication with the discharge opening, whereby the accumulated syrup in the vented bowl of the valve element biases the elastomeric element relative to the discharge opening thereby withdrawing the needle member of the valve element from engagement with the discharge opening and permitting a change in effective size of the discharge opening which is proportional to the viscosity of the syrup being dispensed so that the syrup flow rate through the discharge opening is maintained substantially uniform independent of the viscosity of the syrup.

24. A disposable syrup package according to claim 23, wherein the vented bowl has a plurality of vent holes in its base through which the temporarily accumulated syrup can drain.

25. A disposable syrup package according to claim 24, wherein the bowl's capacity and the number and size of the vent holes are such that the amount of accumulated syrup is sufficient to bias the coil spring to withdraw the needle portion of the stem of the valve element from the discharge opening sufficiently to compensate for a change in the viscosity of the liquid being dispensed to maintain the syrup flow rate substantially uniform.

26. A disposable syrup package according to claim 25, wherein the means for permitting compensating movement of the valve element is a plurality of spokes of elastomeric material extending between the rim and hub of the elastomeric element.

27. A device adapted for use with the dispensing of liquids with a controlled rate of flow which is independent of the viscosity of the liquid at the time of dispensing, the device comprising:

a valve element which is movably aligned and adapted to be placed in cooperative communication with a discharge opening for the liquid to be dispensed to regulate the rate of flow of liquid through the discharge opening, the valve element having means therein for accumulating temporarily a portion of the liquid dispensed through the discharge opening, the magnitude of the portion of the liquid accumulated being directly related to the viscosity of the liquid being dispensed; and an elastomeric element adapted to be positioned at its periphery about the discharge opening and at its interior to the valve element, the elastomeric element being disposed such as to maintain the valve element in cooperative communication with the discharge opening, whereby the accumulated liquid in the valve element biases the elastomeric element relative to the discharge opening thereby withdrawing the valve element from engagement with the discharge opening and permitting a change in effective size of the discharge opening which is proportional to the viscosity of the liquid being dispensed so that the liquid flow rate through the discharge opening is maintained substantially uniform independent of the viscosity of the liquid.

28. A device according to claim 27, wherein the valve element comprises a needle member which is adapted to be in cooperative communication with the discharge opening and a vented bowl depending from the needle member for temporarily accumulating a portion of the liquid.

29. A device according to claim 28, wherein the vented bowl has a plurality of vent holes in its base through which the temporarily accumulated liquid can drain.

30. A device according to claim 29, wherein the bowl's capacity and the number and size of the vent holes are such that the amount of accumulated liquid is sufficient to bias the elastomeric element to withdraw the needle member of the valve element from the discharge opening sufficiently to compensate for a change in the viscosity of the liquid being dispensed to maintain the liquid flow rate substantially uniform.

31. A device according to claim 28, wherein the elastomeric member is affixed, at its interior, to the needle member.

32. A device according to claim 27, wherein the elastomeric member is vented to permit the passage of fluids therethrough.

33. A device according to claim 32, wherein the elastomeric member is comprised of a rim at the periphery, a hub at the interior, and a vented biasable means between the rim and hub for permitting compensating movement of the valve element relative to the discharge opening to maintain the liquid flow rate substantially uniform.

34. A device according to claim 33, wherein the means for permitting compensating movement of the valve element is a plurality of spokes of elastomeric material extending between the rim and hub of the elastomeric element.

35. A device according to claim 34, wherein the valve element comprises a needle member which is in cooperative communication with the discharge opening in the container and a vented bowl depending from the needle member for temporarily accumulating a portion of the liquid, the hub of the elastomeric member being affixed to the needle member.

36. A viscosity compensating device intended for use with a disposable syrup container for use in a post-mix carbonated beverage dispensing system for dispensing a syrup with a controlled rate of flow which is independent of the viscosity of the syrup at the time of dispensing, the viscosity compensating device being adapted to be affixed to a depending flange on the syrup container so as to be positioned across a discharge opening disposed within the depending flange through which the syrup may be dispensed, the viscosity compensating device comprising:

a valve element which is axially aligned and adapted to be placed in cooperative communication with the discharge opening, the valve element being movable along the axis of the discharge opening to regulate the rate of flow of syrup through the discharge opening, the valve element having a round needle valve member which is in cooperative communication with the discharge opening, and a vented bowl depending from the needle valve member for accumulating temporarily a portion of the syrup dispensed through the discharge opening, the magnitude of the portion of the syrup accumulated in the vented bowl prior to its escape from the vented bowl being directly related to the viscosity of the syrup being dispensed; and an elastomeric element which is comprised of a rim at its periphery which is adapted to be affixed to the flange on the syrup container, an interior hub which is affixed to the valve member, and a vented biasable means formed of an elastomeric material between the rim and hub, the elastomeric element being disposed such as to maintain the valve element in cooperative communication with the discharge opening, whereby the accumulated syrup in the vented bowl of the valve element biases the elastomeric element relative to the discharge opening thereby withdrawing the needle member of the valve element from engagement with the discharge opening and permitting a change in effective size of the discharge opening which is proportional to the viscosity of the syrup being dispensed so that the syrup flow rate through the discharge opening is maintained substantially uniform independent of the viscosity of the syrup.

37. A viscosity compensating device according to claim 36, wherein the vented bowl has a plurality of vent holes in its base through which the temporarily accumulated syrup can drain.

38. A viscosity compensating device according to claim 37, wherein the bowl's capacity and the number and size of the vent holes are such that the amount of accumulated syrup is sufficient to bias the elastomeric element to withdraw the needle valve member of the valve element from the discharge opening sufficiently to compensate for a change in the viscosity of the liquid being dispensed to maintain the syrup flow rate substantially uniform.

39. A viscosity compensating device according to claim 38, wherein the means for permitting compensating movement of the valve element is a plurality of spokes of elastomeric material extending between the rim and hub of the elastomeric element.

40. In a post-mix carbonated beverage dispensing system utilizing a disposable syrup container of the type having a discharge opening therein through which the syrup flows for use by the post-mix carbonated beverage dispensing system, a viscosity compensating device comprising:

a valve element which is movably aligned and adapted to be placed in cooperative communication with a discharge opening for the syrup to be dispensed to regulate the rate of flow of syrup through the discharge opening, the valve element having means therein for accumulating temporarily a portion of the syrup dispensed through the discharge opening, the magnitude of the portion of the syrup accumulated being directly related to the viscosity of the liquid being dispensed; and spring means interposed between the valve element and the container for biasably maintaining the valve element in cooperative communication with the discharge opening, whereby the accumulated syrup in the valve element biases the spring means relative to the discharge opening thereby withdrawing the valve element from engagement with the discharge opening and permitting a change in effective size of the discharge opening which is proportional to the viscosity of the syrup being dispensed so that the syrup flow rate through the discharge opening is maintained substantially uniform independent of the viscosity of the syrup.

41. In a post-mix carbonated beverage dispensing system according to claim 40, the valve element further comprises a stem extending through the discharge opening into the interior of the container and the spring means is interposed between the stem and the container.

42. In a post-mix carbonated beverage dispensing system according to claim 41, the stem of the valve element includes a needle portion which is in cooperative communication with the discharge opening in the container and the valve element further comprises a vented bowl depending from the needle portion of the stem for temporarily accumulating a portion of the syrup.

43. In a post-mix carbonated beverage dispensing system according to claim 42, the vented bowl has a plurality of vent holes in its base through which the temporarily accumulated syrup can drain.

44. In a post-mix carbonated beverage dispensing system according to claim 43, the bowl's capacity and the number and size of the vent holes are such that the amount of accumulated syrup is sufficient to bias the spring means to withdraw the needle portion of the stem of the valve element from the discharge opening sufficiently to compensate for a change in the viscosity of the syrup being dispensed to maintain the syrup flow rate substantially uniform.

45. In a post-mix carbonated beverage dispensing system according to claim 41, the spring means is a coil spring surrounding the stem of the valve element.

46. In a post-mix carbonated beverage dispensing system according to claim 45, the coil spring bears, at its distal end, against a shoulder on the stem of the valve member and, at is proximal end, against the interior of the container in a recess formed about the discharge opening.

47. In a post-mix carbonated beverage dispensing system according to claim 40, the valve element includes a needle which is in cooperative communication with the discharge opening in the container, the needle, at its widest, being substantially of the same size as the discharge opening, and the spring means permitting the needle of the valve element to be forced into the discharge opening to stop the flow of syrup from the container.

* * * * *